United States Patent [19]

Holland

[11] 4,037,611

[45] July 26, 1977

[54] AUTOMATIC CIGARETTE SNUFFER AND DISPOSAL DEVICE

[76] Inventor: Andrew P. Holland, 281 W. Mechanic St., New Hope, Pa. 18938

[21] Appl. No.: 684,521

[22] Filed: May 10, 1976

[51] Int. Cl.[2] ..... A24F 13/18; A24F 19/14

[52] U.S. Cl. ..... 131/237

[58] Field of Search ..... 131/237, 235

[56] References Cited

U.S. PATENT DOCUMENTS

| | | | |
|---|---|---|---|
| 2,760,497 | 8/1956 | Campbell | 131/237 |
| 2,777,448 | 1/1957 | Albert | 131/237 |
| 3,113,577 | 12/1963 | Carlson | 131/237 |
| 3,194,247 | 7/1965 | Fox | 131/237 |

*Primary Examiner*—Stephen C. Pellegrino
*Attorney, Agent, or Firm*—Albert Sperry; Frederick A. Zoda; John J. Kane

[57] ABSTRACT

For use with a motor vehicle dashboard or other similar wall type configuration an automatic snuffer and disposal device including a pivotally mounted ashtray enclosure having a generally open upper area defined by two side walls, a rear wall and a front wall, the enclosure pivotally mounted by hinge means along the lower edge thereof for movement to a closed or open position, a stationary pressure plate fixedly mounted to the walls of the enclosure and a moveable pressure plate moveably mounted to the walls of the enclosure, the moveable pressure plate positioned adjacent the stationary crusher plate to form an upwardly facing configuration for receiving cigarettes, cigars and other tobacco materials therein for crushing therebetween, a cam means engageable with the moveable crusher plate when the ashtray enclosure is moved to a closed position to crush tobacco materials between the plates, also including a disposal means operable responsive to movement of the closure toward the open position for urging the moveable and stationary crusher plates apart to allow release of the crushed tobacco material for disposal.

15 Claims, 5 Drawing Figures

AUTOMATIC CIGARETTE SNUFFER AND DISPOSAL DEVICE

BACKGROUND OF THE INVENTION

1. Field of the Invention

The present invention deals with the field of ashtrays for cigars, cigarettes and the like which are especially adaptable for use in motor vehicles such as automobiles. Whenever the driver of a motor vehicle must dispose of a cigar or cigarette, he must momentarily take his eyes off the road. This action has often resulted in vehicle accidents resulting in personal and property injury. In this respect, it is desirable to provide an ashtray device which does not require the operator to snuff the cigar or cigarette but allows the tobacco article to be placed in a location such that the driver may merely close the ashtray and in this operation effectively snuffs and disposes of the article.

Many devices have been designed to achieve this purpose but such devices have proved ineffective. The present invention overcomes the disadvantages of the other devices in this field.

2. Description of the Prior Art

Of the many patents granted on cigarette snuffing and disposal devices, the below list is exempliary.

U.S. Pat. Nos. 2,319,861 filed July 29, 1941; 2,494,979 filed Jan. 17, 1950; 2,888,936 filed June 2, 1959; 2,588,537 filed Mar. 11, 1952; 2,598,175 filed May 27, 1952; 2,626,615 filed Jan. 27, 1953; 2,660,180 filed Nov. 24, 1953; 2,760,497 filed Aug. 28, 1956; 2,777,448 filed Jan. 15, 1957;

Upon review of the above-identified patents, it will be apparent that many types of mechanical movements have been utilized as means in order to achieve the desirable end of snuffing and disposing of cigarette articles without requiring undue attention from the operator of the motor vehicle. As an example, the U.S. Pat. No. 2,760,497 shows a device having several moveable mechanical levers such as 26 which operate in unison to extinguish the cigarette material and then dispose of the remains thereof. This device is quite complicated and difficult to maintain. The present invention is advantageous since only one moveable part, the crusher plate, is designed therein and as such is relatively maintenance free.

The U.S. Pat. No. 2,626,615 shows a device which may be pivotally mounted along the lower edge thereof but which does not include the mechanical leverage and simplicity of the design of the present invention. The present invention requires very little inward pressure due to the leverage between the moveable crusher plate and the cam such that crushing of the cigarette material is facilitated. Also, the use of a retaining means in the form of a magnet provides a device which has virtually an infinite life expectancy and as such further enhances the maintenance advantages of the present invention.

The U.S. Pat. No. 2,588,537 is another example of a detailed configuration which includes several moving parts including the reciprical rod 19, rotating cog 16 and swing plate 14 which may effective in the disposing of cigarette devices but which does require additional maintenance when considered in comparison with the present invention.

Prior art does not show the double action opening and closing operation as shown in the present invention which crushes the cigarette material with the inward movement of the ashtray and releases the cigarette material by the outward movement of the ashtray such that the crushing and disposing operations are performed by such a relatively simple but effective mechanical movement.

SUMMARY OF THE INVENTION

The present invention is particularly adaptable for use with a standardly configured motor vehicle ashtray device. An ashtray enclosure may be configured with a hinge means along the lower edge thereof to facilitate pivotal movement between the ashtray and the dashboard. The ashtray may be configured having two side walls, a front wall and a rear wall with an open upper area to facilitate axcess therein. Preferably the enclosure is moveable between an open and closed position by pivotal movement to place the enclosure within the dashboard in the closed position and extending outward from the dashboard in the opened position.

Within the enclosure, fixedly mounted to the side walls thereof, is a stationary crusher plate which is moveable with the pivotal movement of the ashtray enclosure. Positioned thereadjacent may be a moveable crusher plate including pins positioned on the outward edges thereof which extend through slots in the side walls. In this configuration, as the pins move from one end of the slots to the other ends thereof, relative movement between the crusher plate and the enclosure is provided. Secured to the pins of the moveable crusher plate may be biasing means such as springs or the like which urge the moveable pressure plate to form a v-shape cross-section with the stationary crusher plate when in the relaxed position. In this manner, the biasing means secured to the pins at the upper edge of the moveable crusher plate, may urge the upper edge thereof away from the stationary crusher plate whereas the biasing means or springs secured to the pins at the lower edge of the moveable crusher plate may urge it against the bottom edge of the stationary crusher plate. In this design when in the relaxed position the stationary and moveable crusher plates will form an upwardly facing V-shape. In this configuration, the area between the plates will be adapted to receive variously shaped tobacco materials such as thin cigarettes or large cigars to thereby provide a means for disposing of variously sized tobacco articles.

The rear wall of the enclosure will preferably include an aperture therein through which protrudes a cam means or other surface of abutment which is fixedly mounted to the surrounding environmental structure to allow the enclosure to be pivotally moveable with respect thereto. In this manner as the enclosure is moved to a closed position, the moveable crusher plate will move to contact the cam means and thereby the stationary and moveable crusher plates will be urged together to crush any tobacco articles positioned therebetween. At this point of the movement, the cigarettes or cigars will be snuffed to prevent any further burning or smoldering thereof. When the enclosure is in the fully closed position, the plates will be urged strongly in abutment against one another to create an effective snuffing action.

A magnetic holding means may preferably be positioned adjacent the cam means such that after snuffing as the ashtray is moved from the closed position toward the open position, the upper and lower edges of the moveable pressure plate will be urged away from the stationary crusher plate. In this manner, the crushed cigarette materials between the plates will be released for disposal therebelow into the bottom of the ashtray enclosure. As the ashtray enclosure moves further toward the open position, the ends of the slots and biasing means will overcome the holding force exerted by the magnetic holding means which will free the moveable crusher plate from the holding means to return to the steady state orientation forming a V-shaped upwardly facing configuration with the stationary pressure plate. In this configuration, the ashtray enclosure will be readied for receiving another cigarette article for snuffing and disposal thereof.

The holding means may include a spring mounted magnetic coupling device having limited movement with respect to the cam means to facilitate holding of the moveable crusher plate in the retracted disposal position for a longer period of time during movement of the ashtray enclosure from the closed to the opened position. The ashtray enclosure may also include a handle means conveniently positioned such as on the front surface of the front wall of the ashtray enclosure.

It is an object of the present invention to provide an ashtray device for use with motor vehicles capable of snuffing and disposal of variously shaped tobacco articles.

It is an object of the present invention to provide a means for snuffing and disposal of cigarette articles in a manner to minimize the amount of attention required from a person operating a motor vehicle.

It is an object of the present invention to provide a combination snuffing and disposing device having only one moveable part to facilitate maintenance thereof.

It is an object of the present invention to provide as ashtray device for snuffing and disposal of tobacco devices which utilizes leverage action against a cam means such that little inward pressure is required to effect full snuffing.

It is an object of the present invention to provide an ashtray device moveable between an open and a closed position such that when moved toward the closed position, cigarette articles will be snuffed and, such that when movement from the closed position to the open position, the snuffed cigarette materials will be released to an ash receiving receptacle.

It is an object of the present invention to provide an ash receptacle for mounting in the instrument panel of a motor vehicle for automatic snuffing and disposal of cigarettes, cigars and the like.

It is an object of the present invention to provide a combination cigarette snuffing and disposal device which is simple and sturdy in construction and yet economical to manufacture and assemble.

BRIEF DESCRIPTION OF THE DRAWINGS

While the invention is particularly pointed out and distinctly claimed in the concluding portions herein, a preferred embodiment is setforth in the following detailed description which may be best understood when read in connection with the accompanying drawings, in which:

DETAILED DESCRIPTION OF THE PREFERRED EMBODIMENT

Figure 1:
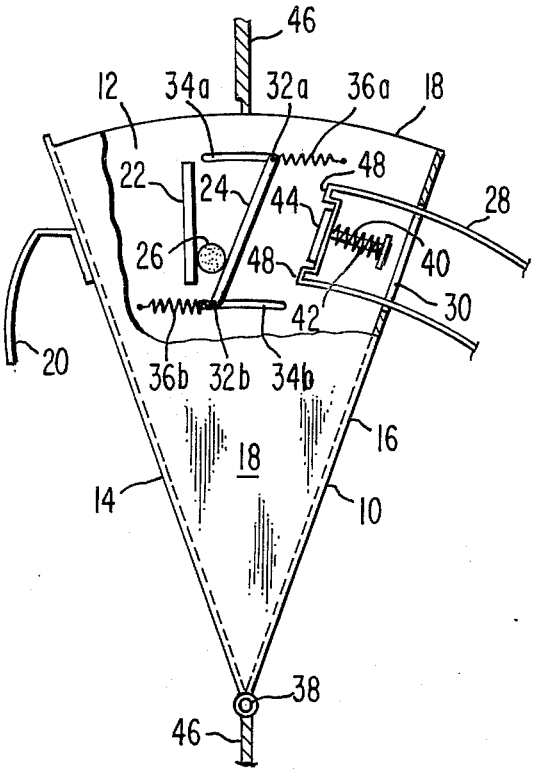
FIG. 1 is an end view of an embodiment of the automatic cigarette snuffer and disposal device of the present invention in the opened position and with a side wall thereof broken away.
Figure 2:
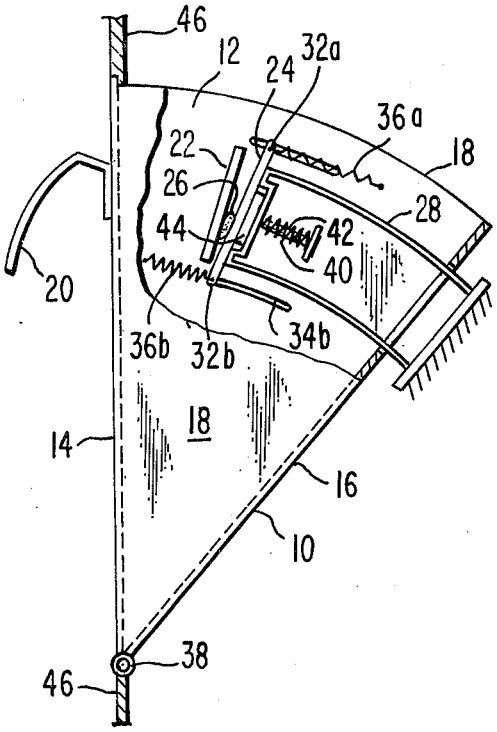
FIG. 2 is a view as shown in FIG. 1 when in the closed position.
Figure 3:
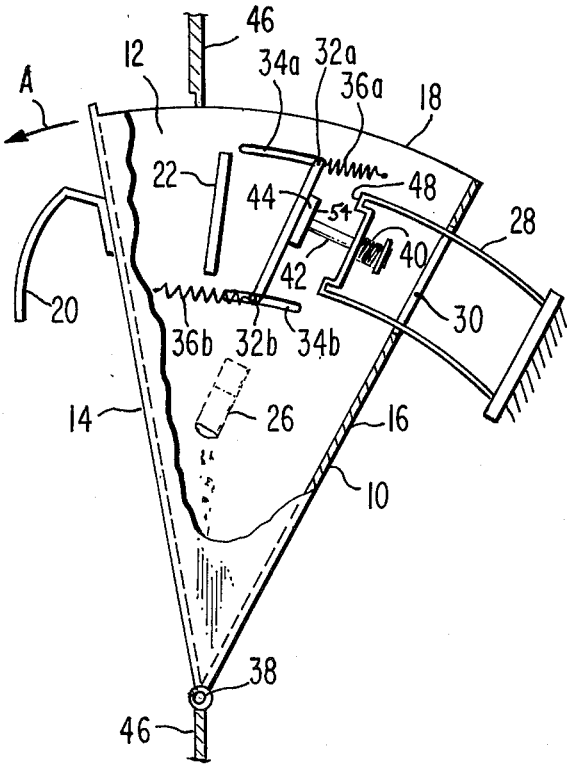
FIG. 3 is a view as shown in FIG. 1 during movement from the closed position to the open position.

The present invention provides an automatic cigarette snuffer and disposal device generally configured in the form of an ashtray enclosure 10 having an open upper area 12 defined by front wall 14, back wall 16 and side walls 18. The enclosure may be moveable between an opened position and a closed position within the surrounding wall or dashboard structure 46. FIG. 1 shows an embodiment of the present invention in the opened position and FIG. 2 shows an embodiment of the present invention in the closed position. FIG. 3 shows another embodiment of the present invention during movement from the closed to the opened position in the direction shown by arrow A. Movement between the opened and closed position may be facilitated by providing a handle means 20 affixed to the front surface of front wall 14. The lower edge of the front wall 14 may have secured thereto a hinge means 38 or the like to provide the pivotal movement of the ashtray enclosure between the opened and closed positions.

A stationary crusher plate 22 may be located within the enclosure 10 and fixedly secured to the walls thereof, preferably secured to side walls 18. In this manner, the stationary crusher plate will only move along with the general movement of the enclosure 12 and relative movement between the enclosure and the stationary crusher plate 22 will be prevented.

Positioned adjacent stationary plate 22 may be a moveable crusher plate 24. Plate 24 is defined as moveable since it is moveable with respect to the stationary plate 22 and with respect to the walls 14, 16, and 18 of enclosure 10. To facilitate movement, between moveable crusher plate 24 and side walls 18, a plurality of slot means 34 may be positioned in said side walls. Plate 24 may include pins 32 disposed outwardly therefrom along the lateral edges thereof to extend through slot means 34. In a preferred embodiment of this invention an upper slot means 34A is shown in FIG. 1 and a lower slot means 34B as shown in FIG. 1 may be positioned adjacent the upper and lower edges of the moveable pleate 24, respectively. Complementary therewith the moveable crusher plate 24 may have upper pins 32A extending through upper slots 34A and lower pins 32B extending through lower slots 34B. In this manner, relative movement between moveable plate 24 and enclosure 10 will be facilitated within the confines the upper and lower slot means 34.

In the relaxed state when the enclosure is in the opened position, it is desirable for the lower edges of plates 22 and 24 to be in abutment and for the upper edges of said plates to be biased apart. To facilitate this relaxed V-shaped configuration, biasing means 36 may be provided in the form of upper biasing means or springs 36A and lower biasing means or springs 36B. In this configuration when the ashtray enclosure is in the opened position as shown in FIG. 1, the upper biasing means 36A will urge the upper edge of moveable crusher plate 24 to the right edge of slot 34A such that it is urged away from the upper end of plate 22 whereas the lower biasing means or springs 36B will urge the lower end of moveable crusher plate 24 to be positioned adjacent the lower edge of stationary crusher plate 22. Therefore, when in the opened position, the ashtray enclosure will present a V-shaped configuration of plates 22 and 24 such as to facilitate the receiving of cigarettes, cigars and other variously shaped and lighted tobacco articles for snuffing and disposal thereof.

The rear or back wall 16 may define an aperture 30 therein through which may protrude an abutment or cam means 28 to be engageable with a rear surface of moveable crusher plate 24. As ashtray 10 is moved to the closed position, the abutting edges 48 of cam means 28 will contact the rear surface of plate 24. In this manner as the ashtray 10 reaches the completely closed position, the plates 22 and 24 will be urged together by a force equal to the inwardly extending force exerted by the person closing the ashtray such that tobacco articles 26 which have been placed between the plates when in the opened position will be crushed and any lighted tobacco article will be thereby snuffed. The cam means 28 may be fixedly mounted to environmental structure to be stationary during relative movement with respect thereto of the entire ashtray enclosure 10. In this manner, full and efficient crushing and snuffing of the tobacco articles is achieved.

The present invention may further include a disposal means 40 which is adapted to urge or pull the moveable crusher plate away from contact with the stationary crusher plate when the enclosure is being moved from a closed position to an opened position. Disposal means 40 may include a holding means 42 which may be configured as a magnetic holding means or other magnetic means 44 for pulling moveable crusher plate 24 from abuttment with stationary crusher plate 22. As the ashtray enclosure 10 is moved toward the opened position, holding means 42 will pull plate 24 from abutment with plate 22 to allow the crushed tobacco materials therebetween to be released for disposal into the ashtray enclosure therebelow. Holding means 42 is adapted to release the moveable crusher plate after release of the crushed tobacco articles therebelow such that removable plate 24 may reassume the V-shaped configuration complementary with respect to stationary crusher plate 22. Magnetic holding means 44 may include a holding spring 50 and a holding shaft 52. Preferably, holding shaft 52 is moveably mounted with respect to the environmental structure such that magnetic means 44 will be able to move outward slightly in conjunction with the outward movement of the moveable crusher plate 24 as the enclosure 10 moves from the closed to the opened position. As the magnetic holding means 44 moves further from its stationary position, the pressure exerted to restore it to its mounting location is increased by the increased pressure exerted by the compression of spring 50. In this configuration, the holding shaft 52 must be moveably mounted with respect to the environmental structure to allow spring 50 to exert a restoring force sufficient to restore the magnetic holding means 44 to its mounting position when the ashtray enclosure 10 reaches the opened position.

Figure 5:
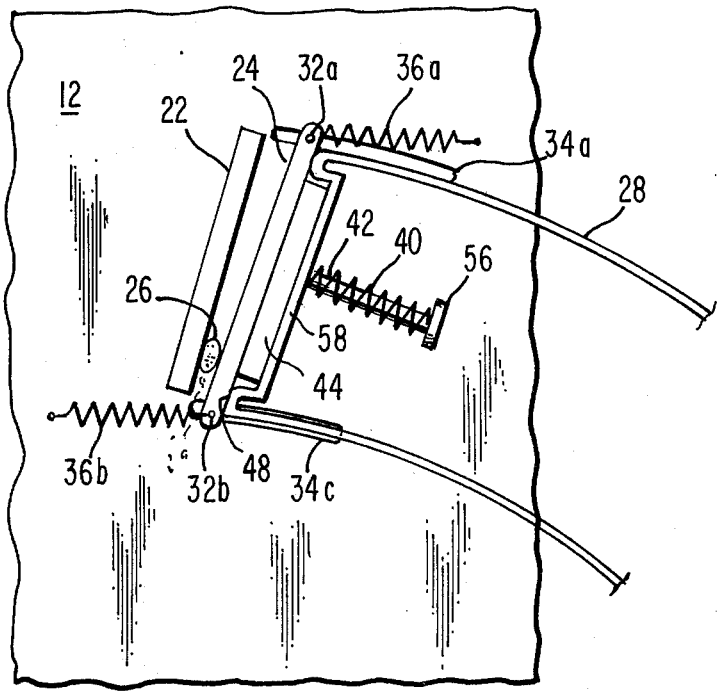
FIG. 5 is a magnified end view of the crusher plates, cam means, and magnetic holding means of the present invention as configured when the ashtray enclosure is in the closed position.

In operation, the ashytray 10 will initially assume an opened position as shown in FIG. 1 with the stationary plate 22 and the moveable plate 24 providing an upwardly facing V-shaped receptacle into which the operator may place a lighted tobacco article such as a cigarette, cigar, pipe ashes and the like. A mere slight glance downward will inform the motor vehicle operator that the automatic cigarette snuffer and disposal device is in the proper opened position to accept a lighted cigarette or the like. Only a quick glance will be required for the operator to place the tobacco article 26 between the plates 22 and 24. Once the article 26 is in place, the operator may return his eyes to the road and crushing and disposal of the article may now be accomplished with little or no attention from the driver. In particular, the driver will now merely grip the handle 20 and exert an inward force to close the ashtray. As the tray moves inward, the abutting edges 48 of the cam means 28 will initially contact the rear surface of the moveable pressure plate 24. As the ashtray 10 is moved further inwardly toward the closed position, the front surface of plate 24 and the rear surface of plate 22 will be pushed together to effectively and efficiently crush and snuff the cigarette or other tobacco article 26 positioned between the plates. When the enclosure is in the finally closed position, the device of the present invention will be configured as shown in FIGS. 2 and 5.

In the fully opened position, it should be appreciated that the lower biasing means or spring 36B will urge the lower pins 32 and the lower end of moveable crushable plate 24 into abutment with the front edge of lower slots 24B and the bottom edge of stationary crusher plate 22. At the same time, the upper biasing means or springs 36A will urge the upper pins 32A and the upper edge of moveable crusher plate 24 into abutment with the rear edge of upper slots 34A such as to be biased away from the upper edge of stationary crusher plate 22. In this manner, the V-shaped configuration for conceiving variously sized tabacco articles will be achieved. The action of the upper springs 36A and the lower springs 36B does differ distinctly when the enclosure is moved to the above described closed position. In particular the lower biasing means or springs 36B will work with the abutting edges 48 of cam means 28 in aid in urging the plate 22 and 24 together. However, the upper biasing means or springs 36A will tend to exert a force to resist compressing of the upper edges of plates 22 and 24. Therefore, when the enclosure 10 is in the closed position, shown in FIGS. 2 and 5, the lower springs 36B will be in a compressed state whereas the upper springs 36B will be in a fully or almost fully expanded or stretched state.

Figure 4:
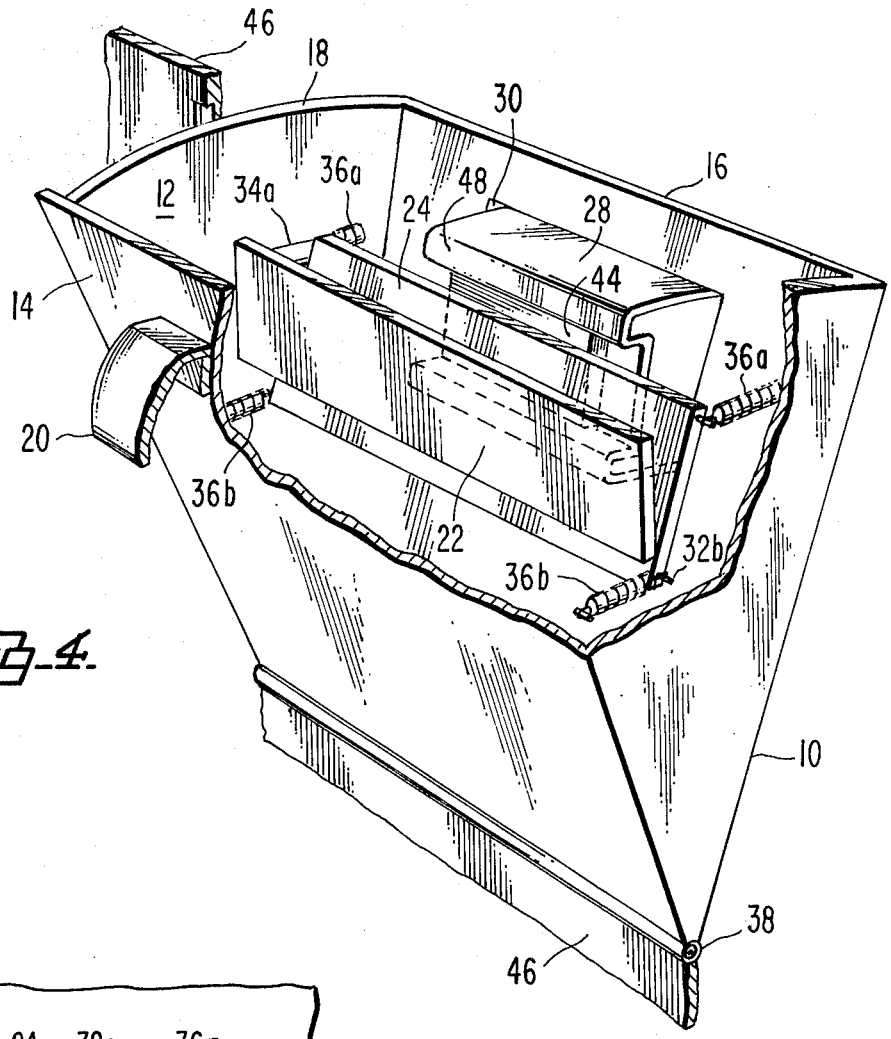
FIG. 4 is a perspective view of an embodiment of the present invention in the opened position having portions of the front and side wall broken away to facilitate the illustration.

As shown in the figures depicting embodiments of the present invention, the magnetic holding means 44 may include a magnet 54, a holding shaft 52, a holding spring 50 and a retainer 56. The holding shaft 52 is preferably mounted moveable with respect to the environmental structure such as frame 58. The moveable crusher plate 24 is preferably made of a material which is attracted to magnet 54. In this respect when in the fully closed position, the magent 54 will be attracted and secured to the rear surface of moveable crushable plate 24. As movement from the closed position to the opened position is initiated, the magnet 54 will move with the movement of plate 24 away from cam means 28. At the same time spring 50 will be compressed between retainer 56 and frame 58 to exert a bias tending to return magnet 54 to its stationary position. Contact between magnet 54 and plate 24 will continue until the oppositely directed biases overcome the magnet attractive force between plate 24 and magnet 54. However, during the initial stages of movement of the enclosure 10 to the opened position, lower springs 36B will be expanded such that the lower edges of plates 22 and 24 will separate to allow the disposal therebelow of the crushed tobacco materials 26 therebetween. This configuration is most clearly shown in FIG. 4 in which the magnet 54 is extended outwardly but still in a position of abutment with moveable plate 24. Also lower springs 36B are fully extended when the lower edges of plates 22 and 24 are separated. As enclosure 10 is moved further toward the opened position, the force exerted by lower spring 36B and the abutment of the pins 32A and 32B against the inward edges of upper and lower slots 34B will overcome the magnetic attractive force between plate 24 and magnet 54 to release the magnetic holding means. The magnet 54 will be returned to its stationary position abutting frame 58 by the force exerted by spring 50 between retainer 56 and frame 58. At the same time, moveable crusher plate 24 will return to the steady state configuration as determined by the upper and lower spring biases. The stationary and moveable pressure plates 22 and 24 will not again assume the upwardly facing V-shaped configuration adapted for receiving the placement of lighted tobacco materials 26 therebetween for crushing. In this manner, a most efficient and convenient and yet economical and relatively maintenance-free cigarette snuffer and disposal device is shown.

While particular embodiments of this invention have been shown and described above, it will be apparent that many changes will be made in the form, arrangement and positioning of the various elements of the combination. In consideration thereof, it should be appreciated that preferred embodiments of this invention disclosed herein are intended to be illustrative only and not intended to limit the scope of the invention.

I claim:

1. An automatic cigarette snuffer and disposal device comprising:

a. a moveable ashtray enclosure having an open upper area, said enclosure including a front wall, a rear wall and two side walls, said enclosure being selectively moveable between a closed and an opened position said side walls defining slot means therein;

b. a stationary crusher plate fixedly mounted to said enclosure to be moveable therewith;

c. a moveable crusher plate being moveably mounted to said enclosure and positioned adjacent said stationary plate said moveable crusher plate including laterally disposed pins extending through said slot means to facilitate movement between said crusher plate and said enclosure;

d. cam means selectively engageable with said moveable plate responsive to said ash tray being moved toward a closed position to urge said moveable plate against said stationary plate and crush and snuff tobacco materials and the like located therebetween; and e. disposal means operable responsive to movement of said enclosure to the opened position to urge said moveable crusher plate away from said stationary crusher plate to release crushed tobacco materials from between said plates for disposal therebelow.

2. The device as defined in claim 1 further including a hinge means, said enclosure means being pivotally secured to any stationary surrounding environmental structure by said hinge means along the bottom thereof along the edge of intersection between said rear wall and said front wall.

3. The device as defined in claim 1 further comprising an upper biasing means for urging the upper end of said moveable crusher plate away from said stationary crusher plate and a lower biasing means for the lower end of said moveable crusher plate toward said stationary crusher plate to provide a V-shaped receptacle for receiving tobacco material and the like therein for snuffing and disposal thereof.

4. The device as defined in claim 3 wherein said upper biasing means and said lower biasing means comprise spring means fixedly mounted at one end to said enclosure and fixedly mounted at the other end to said pins on said moveable crusher plate.

5. The device as defined in claim 1 wherein said rear wall of said enclosure defines an aperture therein, and said cam means being fixedly secured to any stationary environmental structure and extending through said aperture to be engageable with said moveable crusher plate whenever said ashtray enclosure is moved to a closed position to crush tobacco material and the like located between said plates and disengageable with said moveable crusher plate to allow the cigarette material and the like to be released therebelow when said enclosure is moved to an opened position.

6. The device as defined in claim 1 wherein said disposal means includes holding means for temporarily maintaining contact between said cam means and said moveable crusher plate when said enclosure is moved toward the opened position to release crushed material into the ashtray enclosure therebelow.

7. The device as defined in claim 6 further including a biasing means for biasing said moveable plate into position with respect to said stationary plate and wherein said holding means maintains contact between said cam means and said moveable crusher plate during movement to an opened position until said biasing means is actuated and said holding means is released.

8. The device as defined in claim 7 wherein said holding means is a magnetic means.

9. The device as defined in claim 1 wherein said disposal means includes a magnetic means for holding said moveable crusher plate in contact with said cam means during initial stages of movement of said enclosure toward the opened position to release crushed material to fall therebelow into said ashtray enclosure.

10. The device as defined in claim 1 wherein said disposal means further includes a bias-mounted moveable magnetic holding means for releasably biasing said moveable crusher plate away from said stationary crusher plate during initial movement of said enclosure to an opened position to allow release therebelow of crusher material from between said plates.

11. The device as defined in claim 1 wherein said plates are biased to present a V-shaped cross-section to be adapted to receive variably shaped and sized materials to be crushed therebetween.

12. The device as defined in claim 1 further comprising a handle means secured to the front surface of said front wall of said enclosure to facilitate movement thereof.

13. The device as defined in claim 1 wherein said moveable ashtray enclosure is pivotally moveable.

14. An automatic cigarette snuffer and disposal device comprising:

a. an ash tray enclosure pivotally mounted to surrounding environmental structure, said enclosure including an open upper area, a front wall, a rear wall and two side walls, said enclosure being pivotally moveable with respect to any surrounding evniromental structure to an opened position allowing access therein through said open upper area and to a closed position, said front wall including a hinge means along the lower edge thereof to provide pivotal movement, said side walls defining slot means therein and said rear wall defining an aperture therein;

b. a stationary crusher plate fixedly secured to said side walls of said enclosure to be moveable therewith;

c. a moveable crusher plate being moveably mounted to said side walls of said enclosure and positioned adjacent said stationary plate, said moveable crusher plate including laterally disposed pins extending through said slot means in said side walls and moveable therein;

d. a cam means selectively engageable with said moveable plate responsive to said ashtray being moved toward a closed position to urge said moveable plate against said stationary plate and crush tobacco material and the like located therebetween, said cam means being fixedly secured to environmental structure and extending through said aperture in said rear wall to selectively abut said moveable crusher plate;

e. disposal means operable responsive to pivotal movement of said enclosure from a closed position position to urge said moveable crusher plate away from said stationary crusher plate to release for disposal therebelow the crushed tobacco material and the like from between said plates;

f. upper and lower biasing means fixedly mounted at one end to said enclosure and at the other end to said pins on said moveable crusher plate, said upper biasing means urging the upper edge of said moveable crusher plate away from said stationary crusher plate and said lower biasing means urging said lower edge of said moveable crusher plate toward said stationary crusher plate to form a V-shaped configuration between said plates for receiving tobacco material and the like for snuffing and disposal thereof; and g. spring-mounted magnetic holding means engageable with said moveable crusher plate for urging said movable crusher plate away from said stationary crusher plate during the initial stage of movement of said enclosure from the closed position to the opened position to allow disposal of crushed material therebelow from between said plates.

15. The device as defined in claim 14 wherein said upper and lower biasing means comprise springs.

* * * * *

UNITED STATES PATENT AND TRADEMARK OFFICE

CERTIFICATE OF CORRECTION

PATENT NO. : 4,037,611

DATED : July 26, 1977

INVENTOR(S) : Andrew P. Holland

It is certified that error appears in the above-identified patent and that said Letters Patent are hereby corrected as shown below:

In Claim 3, line 4, after the word "for", insert the word -- urging --.

In Claim 10, line 51, change the word "crusher" to -- crushed --

In Claim 14(e), line 3, delete the word "position".

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*